US007278631B1

(12) United States Patent
Pratt

(10) Patent No.: US 7,278,631 B1
(45) Date of Patent: Oct. 9, 2007

(54) COMPOSITE SUPPORT SYSTEM FOR A FILL MEDIA COOLING TOWER

(76) Inventor: Stanley P. Pratt, Highway 13 North, P.O. Box 95, Lobelville, TN (US) 37097

( * ) Notice: Subject to any disclaimer, the term of this patent is extended or adjusted under 35 U.S.C. 154(b) by 178 days.

(21) Appl. No.: 11/151,999

(22) Filed: Jun. 14, 2005

Related U.S. Application Data

(60) Provisional application No. 60/591,812, filed on Jul. 28, 2004.

(51) Int. Cl.
*B01F 3/04* (2006.01)

(52) U.S. Cl. ..... 261/112.1; 261/DIG. 11; 52/633; 211/182

(58) Field of Classification Search ..... 261/108, 261/112.1, DIG. 11; 52/633; 211/182
See application file for complete search history.

(56) References Cited

U.S. PATENT DOCUMENTS

| | | | | |
|---|---|---|---|---|
| 2,342,952 | A * | 2/1944 | Mart | 261/108 |
| 4,202,847 | A * | 5/1980 | Ernst et al. | 261/161 |
| 4,591,462 | A * | 5/1986 | Peterson | 261/108 |
| 4,678,615 | A * | 7/1987 | Stambolov et al. | 261/111 |
| 4,803,018 | A | 2/1989 | Lefevre | 261/111 |
| 5,112,371 | A | 5/1992 | Tippmann | 55/233 |
| 5,227,095 | A | 7/1993 | Curtis | 261/30 |
| 5,236,625 | A * | 8/1993 | Bardo et al. | 261/24 |
| 5,958,306 | A | 9/1999 | Curtis | 261/30 |
| 6,237,900 | B1 | 5/2001 | Drew | 261/111 |
| 6,460,832 | B1 | 10/2002 | Mockry | 261/112.1 |
| 6,517,058 | B1 | 2/2003 | Engh | 261/112.1 |
| 6,715,740 | B2 | 4/2004 | Engh | 261/112.1 |
| 2005/0016945 | A1 * | 1/2005 | Yang et al. | 211/181.1 |

* cited by examiner

*Primary Examiner*—Scott Bushey
(74) *Attorney, Agent, or Firm*—Waddey & Patterson, P.C.; Phillip E. Walker

(57) ABSTRACT

A base for a cooling tower having a fill media heat exchange system. The cooling tower, or heat transfer device, includes a plurality of heat exchanging plates positioned to form the fill media, a moisture collection area positioned under the heat exchanging plates, and a composite base supporting the heat exchanging plates and positioned substantially within the moisture collection area. The base includes a plurality of elongated supports, wherein each support includes a length, an aperture, and a plurality of openings. The aperture traverses the supports substantially parallel to the length while the openings traverse the supports substantially perpendicular to the length. The combination of the aperture and openings allows the flow of moisture and water within the moisture collection area to flow in at least two substantially perpendicular directions within the moisture collection area.

19 Claims, 5 Drawing Sheets

COMPOSITE SUPPORT SYSTEM FOR A FILL MEDIA COOLING TOWER

CROSS-REFERENCES TO RELATED APPLICATIONS

This application is a Non-Provisional Utility application which claims benefit of co-pending U.S. Patent Application Ser. No. 60/591,812 filed Jul. 28, 2004, entitled "Composite Support System For A Fill Media Cooling Tower" which is hereby incorporated by reference in its entirety.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described herein are hereby incorporated by reference in their entireties.

BACKGROUND OF THE INVENTION

The present invention relates generally to air processing equipment used in residential, commercial, and industrial settings. The present invention relates to a base for an evaporative heat exchanging device used in air or water processing equipment. More specifically, the present invention includes to a base support structure for a bottom supported fill media used in an evaporative heat exchanging device known as a cross flow cooling tower.

It is known in the art to use air handling equipment to cool, heat, moisturize, dry, or otherwise condition or process air for a variety of uses. These uses can include the climate control of the particular space into which people or animals will occupy or the manipulation of air or water used in other industrial processes. One device commonly used in the conditioning of air is the evaporative cooling device, which is also known as a cooling tower. Typically in a cross flow cooling tower, air is drawn through a media over water to create evaporative cooling wherein the cool water is then used in a heating exchanger of another piece of air processing equipment, for example, an air conditioner. In the typical cross flow cooling tower, a flow of air and a flow of water travel in substantially perpendicular paths to one another. The water normally travels down various sheets of plastic through channels or flutes used to enhance the heat exchange between the water and the air. These sheets of, typically PVC, are known in the art as fill media. These can be sheets either supported from the top using a rod assembly or can be bundled fill packs supported off the cold water basins.

For example, U.S. Pat. Nos. 5,227,095, 5,958,306, 6,237,900, 6,460,832, 6,517,058 and 6,715,740 all disclose cooling towers or types of fill media, also known as film sheets or fill packs, used in cooling towers. As a review of these patents shows, most of the consorted effort to improve the cooling towers has been in the redesign of the actual sheets that make up the fill media or in the working portions of the cooling tower which include the water distribution and air circulation systems.

Most of these prior art patents have overlooked the basic support structure used in connection with a bottom supported fill media in a cross flow cooling tower. For example, most of the prior art used wood or metal supports for the structure, or framework, to elevate the fill bundles off of the cold water basins. Normally this is galvanized metal. Additionally, little thought has been given to the proper location of the various components that set down and position the prior art support structures. The prior art structures are normally positioned on the cold water basins often time putting excessive stress on the pan sections due to the weight of the complete fill assembly not being equally distributed across the cold water basin pan sections.

The prior art support structures fail to appreciate a need to vary the height of the fill media off the cold water basins within various cross flow cooling towers. Additionally, the prior art fails to appreciate a need for proper water flow within the cold water basin of the cooling tower. As such, the prior cooling towers have a tendency to develop low spots or "trap" locations in which silt and debris are held and can become stagnant and collect bacteria and other unwanted impurities. When maintenance is performed on these prior art cooling towers, the low spots, or trap locations hold the silt and debris which can adversely affect the ultimate performance of the air handling equipment.

What is needed then is an improved support system for heat and mass transfer devices used in the processing of air. This needed support preferably allows for multiple flow directions of water held in the cold water basin of a cooling tower as well as adjustments in the positioning of the elements that comprise the base in order to properly support the fill media. This needed base is lacking in the art.

BRIEF SUMMARY OF THE INVENTION

Included herein is a support base for a crossflow cooling tower having a bundled fill pack arrangement used as the media for the heat exchange system. The cooling tower, or heat transfer device, comprises a plurality of heat exchanging plates positioned to form the fill media, a moisture collection area positioned under the heat exchanging plates, and a composite base supporting the heat exchanging plates and positioned substantially within the moisture collection area. The base includes a plurality of elongated supports, wherein each support includes a length, an aperture, and a plurality of openings. The aperture traverses the supports substantially parallel to the length while the openings traverse the supports substantially perpendicular to the length. The combination of the aperture and openings allows the flow of moisture and water within the moisture collection area to flow in at least two substantially perpendicular directions within the moisture collection area.

In a preferred embodiment each elongated support further includes a top, sides, a bottom, a first end, and a second end. Indentions are positioned in the top perpendicular to the length and a plurality of cross rails can be positioned in the indentions to support the fill media and connect adjacent supports. Alternately, the cross rails can be positioned on the top of the supports and engage the fill media to vary the vertical positioning of the fill media relative to the supports.

Preferably the openings are positioned in the sides of each support wherein for each given support the openings are aligned to allow a direct pass through of water through these supports. These openings in combination with the aperture of a given support can be described as allowing the moisture to flow in first and second directions where the first and second directions are substantially perpendicular to one another.

The base can further include first and second locating plates wherein the first locating plate is located proximate to the first end of the support and a second locating plate is positioned proximate to the second end of the support. The first and second locating plates can be substantially perpendicular to each support and extend upward in a generally vertical direction from each support. The first and second locating plates are aligned in combination with the supports and the cross rails to substantially position the fill media on the base in a preferred location for the operation of the cooling tower.

In a most preferred embodiment the base, including the supports, cross rails, and locating plates, is composed of composite material. This composite material is preferably a fiber reinforced PolyVinyl Chloride (PVC) or High Density Polyethylene. This composite material is advantageous in that it is cheaper to make than conventional metal bases used in cooling towers. Additionally, the composite material will not corrode or deteriorate when subjected to the high moisture and the water chemistry used in cooling towers. The use of composites will also allow easy variances in the size of the individual bases while allowing for a consistent replication of supports to provide a uniform base under the fill media. The consistent size and dimensions of the supports can be critical especially when the sizes of cooling towers can be several stories high and occupy a footprint space several hundred feet squared.

It is therefore a general object of the present invention to provide a base support structure for an evaporative heat exchanging device.

Another object of the present invention is to provide a base for a cooling tower.

Another object of the present invention is to provide a base for a fill media used in a cooling tower.

Another object of the present invention is to provide a base used to support heat exchanging plates in an evaporative cooling device.

Another object of the present invention is to provide a composite base used in cooling towers.

Another object of the present invention is to provide a base for a cooling tower that can vary the height of the fill media relative to the surrounding framework of the cooling tower.

Another object of the present invention is to provide a base for a cooling tower that allows the flow of fluid in two substantially perpendicular directions within a cooling tower.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
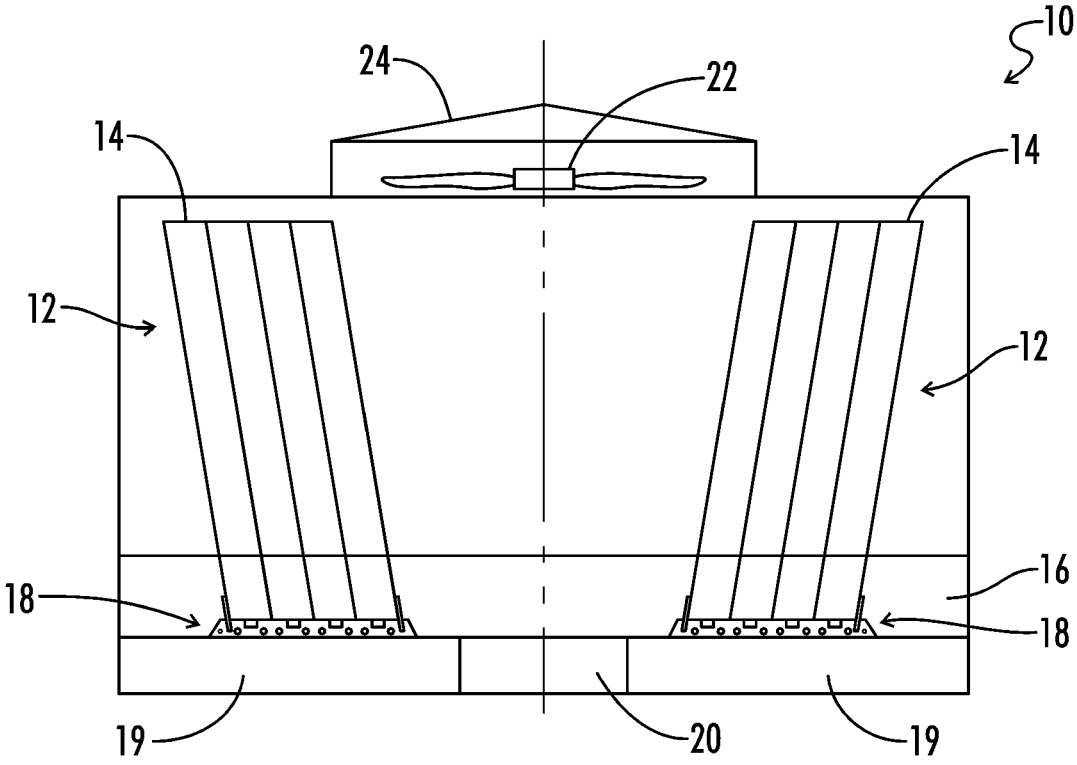
FIG. 1 is a cross sectional end view of a cooling tower made in accordance with the current disclosure.
Figure 2:
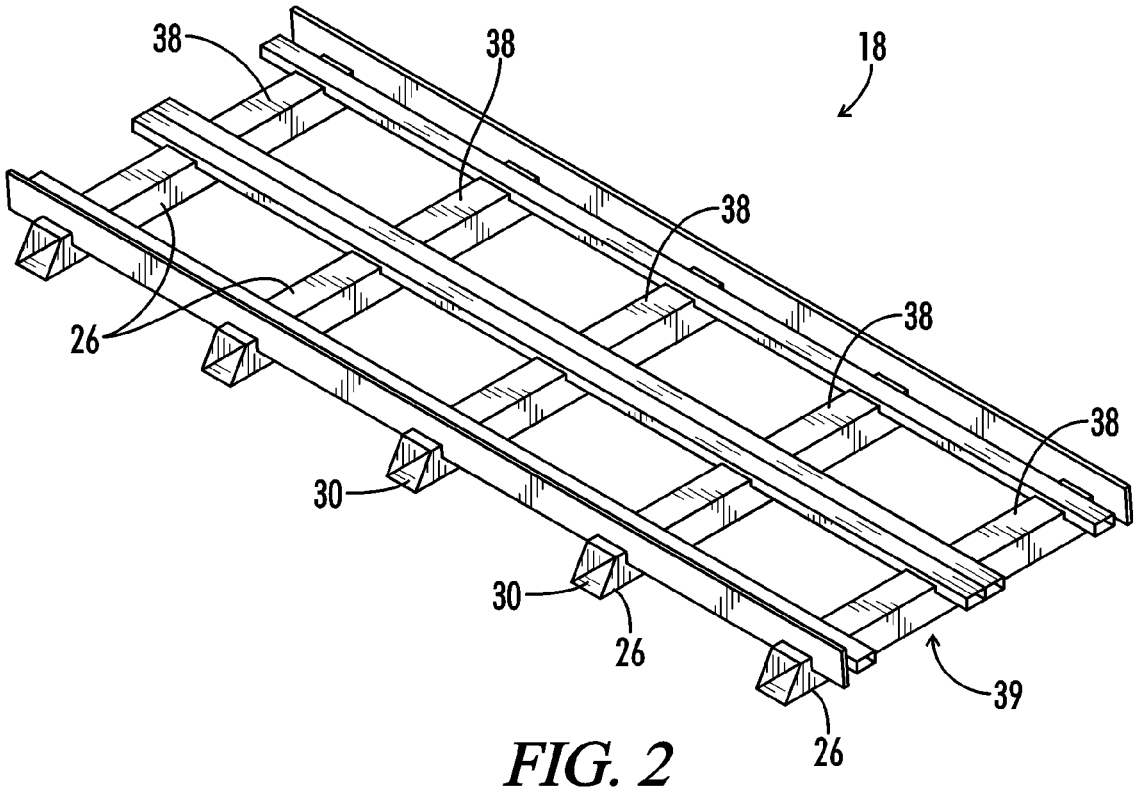
FIG. 2 is a perspective view of a base for a cooling tower made in accordance with the current disclosure.
Figure 3:
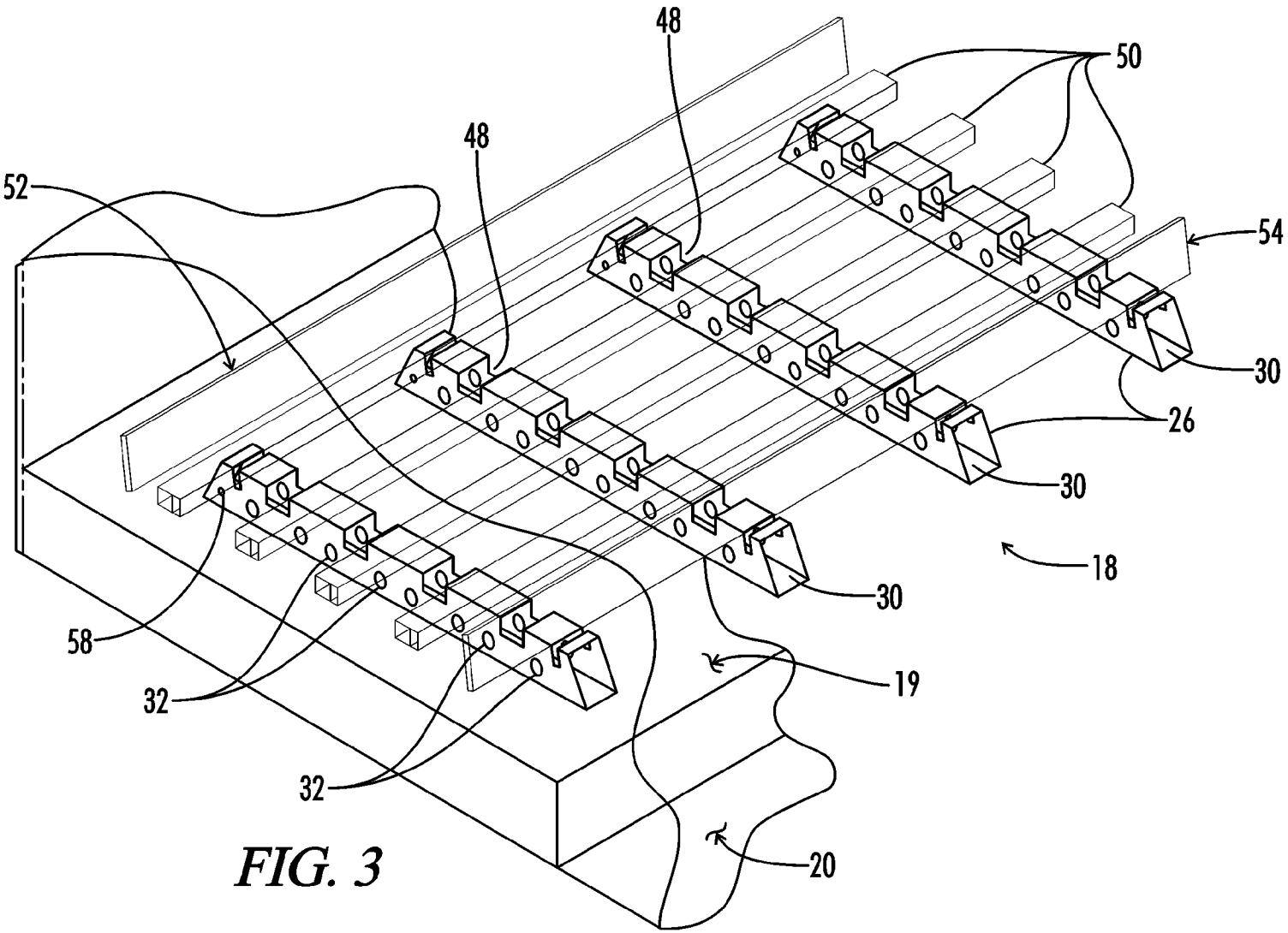
FIG. 3 is a partial cutaway casing of a cooling tower.
Figure 5:
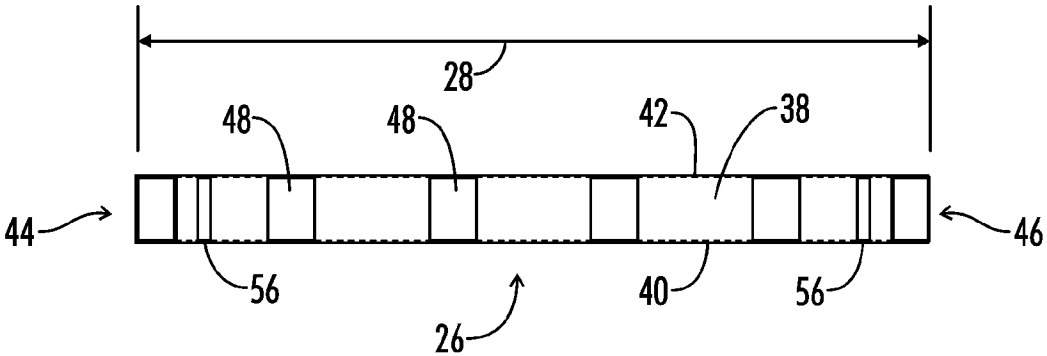
FIG. 5 is a top view of the support shown in FIG. 4.
Figure 4:
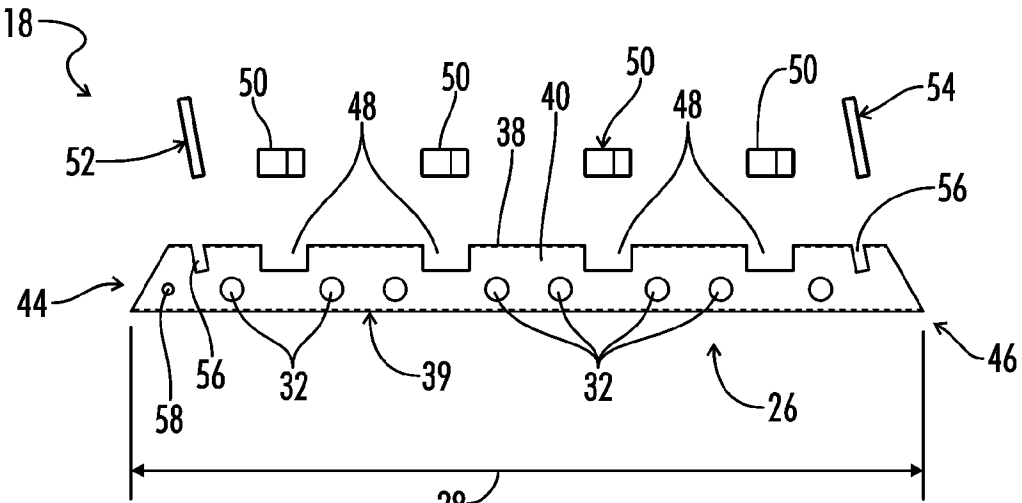
FIG. 4 is an expanded side view of an embodiment of a base made in accordance with the current disclosure.
Figure 6:
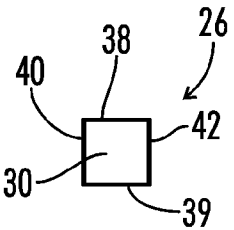
FIG. 6 is an end view of the support shown in FIGS. 4 and 5.
Figure 7:
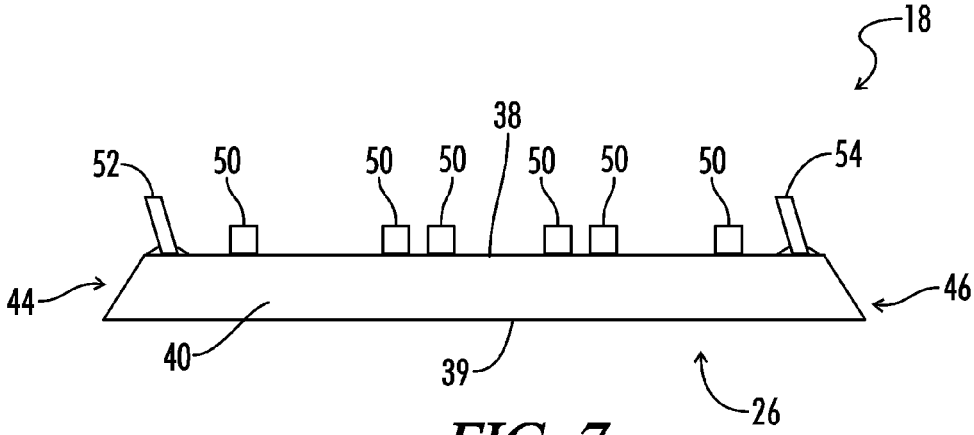
FIG. 7 is a side view of an alternate base made in accordance with the current disclosure.
Figure 8:
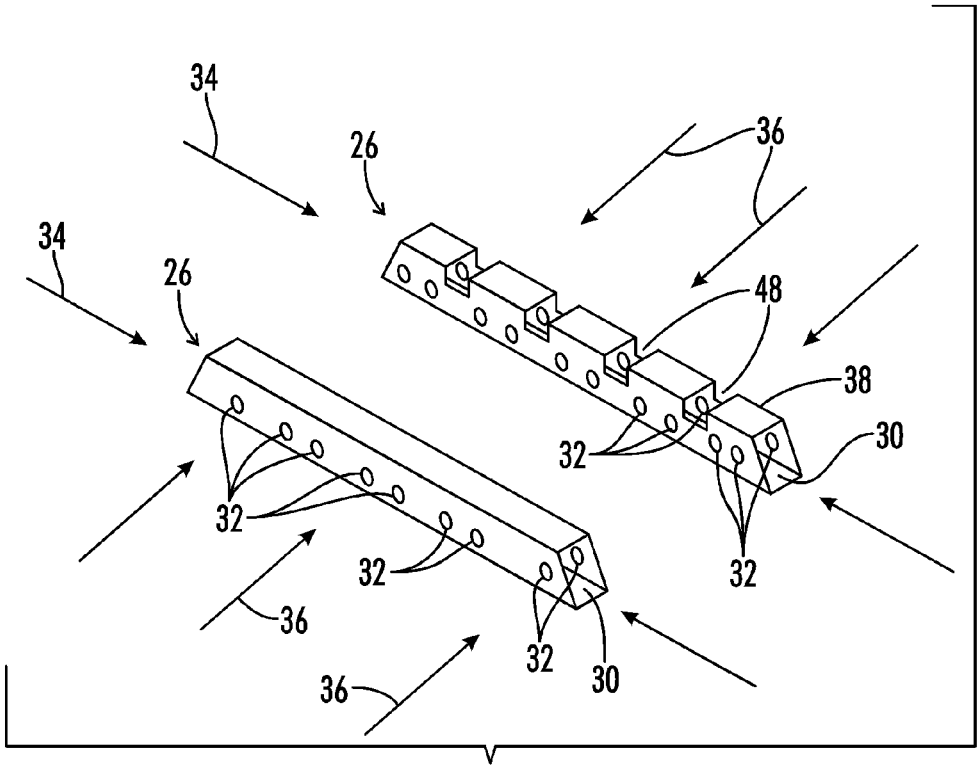
FIG. 8 is a perspective view showing an example of multiple fluid flow directions permitted by supports of a base made in accordance with the current disclosure.

Referring generally now to FIGS. 1-6 a cooling tower is generally shown and designated by the numeral 10. The cooling tower 10, which can also be described as an evaporative heat exchanging device 10, is normally used in conjunction with an air processing system (not shown). The cooling tower 10 comprises a heat exchange system 12, which can be described as fill media 12. The fill media 12 comprises a plurality of heat exchanging plates 14 proximately positioned to form the fill media 12. A moisture collection area 16, which can be described as a cold water basin 16, is positioned under the heat exchanging plates 14 that form the fill media 12. The cold water basin 16 collects the moisture, or water, that has been cooled in the cooling tower for its subsequent use in air handling or other industrial processes.

The cooling tower 10 can further include a lower section 20, which can also be described as a subsection 20, in which the water flows for subsequent use in air or industrial processes. A fan 22 and fan housing 24 can also be positioned on, or in, a cooling tower 10 to direct air flow within the cooling tower 10. A composite base 18 supports the heat exchanging plates 14 and is positioned substantially within the moisture collection area 16.

In a preferred embodiment the base 10 includes a plurality of elongated supports 26. Each support 26 includes a length 28, an aperture 30, and a plurality of openings 32. The aperture 30 can be described as being positioned to substantially span the length 28 of the support 26. Alternately, the aperture 30 can be described traversing the supports 26 substantially parallel to the length 28. Alternately, the aperture 30 can be described as establishing a substantially hollow channel-like shape in each support 26. The openings 32 traverse the supports substantially perpendicular to the length 28. The aperture 30 and openings 32 are positioned to allow the flow of moisture in a first direction 34 and a second direction 36 wherein the first and second directions 34 and 36 are substantially perpendicular to one another.

Each support 26 includes a top 38, a first side 40, a second side 42, a first end 44, and a second end 46. A plurality of indentations 48, which can also be described as notches 48, can be spaced along the length 28 of each support 26. The indentations 48 can be substantially perpendicular to the length 28 and can be positioned in the top 38.

The openings 32 are positioned in the sides 40 and 42 of each support 26. Preferably the openings 32 are substantially aligned between the sides 40 and 42 to facilitate a proper movement of fluid through each support 26. This preferred movement of fluid is further enhanced by aligning adjacent supports 26 and the openings 32 of those adjacent supports 26 to facilitate the flow of fluid.

The base 18 further includes a plurality of cross rails 50 wherein the cross rails 50 are positioned on the top 38 of each support 26. The cross rails 50 engage the heat exchange system 12 and more particularly the heat exchanging plates 14 that comprise the fill media 12. In a preferred embodiment, the cross rails 50 are positioned in the indentations 48, or notches 48, and connected adjacent supports 26 to support the fill media 12.

The base 18 further includes first and second locating plates 52 and 54 wherein the first and second locating plates 52 and 54 are positioned proximate to the first end 44 and second end 46, respectively, of each support 26. Preferably the first and second locating plates 52 and 54 are substantially perpendicular to each support 26 and substantially position the heat exchanging system 12 and heat exchanging plates 14 on the base 18. The supports 26 further include grooves 56 on each end 44 and 46 that are shaped to accept one of the locating plates 52 or 54. Alternately, the first and second locating plates 52 and 54 can engage the top 38 of each support 26 to locate the fill media 12.

Each end 44 and 46 can include an outward slope from the top 38 to the bottom 39. This slope of each end 44 and 46 further facilitates the flow of fluid within the cooling tower 10. The supports 26 can include a locating mark 58, which can also be an opening mark 58, used to help properly install the base 18 into a cooling tower 10.

In a most preferred embodiment the base 18 is comprised of composite material which reduces the need for fastening hardware between the heat exchange system 12 and the base 18. Additionally, this design offers a more unified weight distribution of the load over the moisture collection area 16 and more specifically the inventive base 18. This type of composite base 18 is non-corrosive, lightweight and offers a more unified capacity as compared to conventional supports comprised of wood or steel, be it galvanized, stainless or another form. This type of base 18 can be especially useful when used in retrofitting a conventional top supported fill media into a bottom supported fill pack bundle arrangement as is becoming popular in the art. The inventive composite base 18 allows for the fill media to be raised off the bottom structure 19, which can also be described as a slab 19, which normally comprises the bottom portion of a cooling tower 10. This raised elevation further facilitates cleaning and maintenance of the cooling tower 10.

Another feature of the current invention is the lack of fasteners used in the construction of the base 18. Namely, the supports 26, the plurality of cross rails 50, and the first and second locating plates 52 and 54 are designed to engage one another without the aid of conventional fasteners. Preferably these elements of the base 18 include a frictional fit between one another. Alternately, the plurality of cross rails 50 and the first and second locating plates 52 and 54 are simply supported by the supports 26. The supports 26 also facilitate the positioning of the plurality of cross rails 50 and the first and second locating plates 52 and 54 relative to one another.

Various dimensions and heights of the base 18 can be utilized and still stay with the inventive nature of the current invention.

Thus, although there have been described particular embodiments of the present invention of a new and useful Composite Support System For A Fill Media Cooling Tower, it is not intended that such references be construed as limitations upon the scope of this invention except as set forth in the following claims.

What is claimed is:

1. A base for a cross flow cooling tower having a fill media and a moisture collection area, the base comprising:

a plurality of elongated supports, each support including a top, a first side, a second side, a bottom, a length, a first end, a second end, an aperture, and a substantially hollow channel shape;

a plurality of cross rails positioned substantially perpendicular to the supports, each cross rail engaging the top of the supports and connecting adjacent supports;

a first locating plate positioned proximate to the first end of each support and substantially perpendicular to the supports;

a second locating plate positioned proximate to the second end of each support and substantially perpendicular to the supports;

wherein the first and second locating plates substantially position the fill media on the base;

wherein each support includes a plurality of notches spaced along the length and traversing the support substantially perpendicular to the length;

wherein the plurality of cross rails are positioned in the notches; and each support further including a plurality of openings positioned substantially perpendicular to the length, wherein moisture within the moisture collection area flows through the aperture in a first direction and through the openings in a second direction substantially perpendicular to the first direction.

2. A base for a cross flow cooling tower having a fill media and a moisture collection area, the base comprising:

a plurality of elongated supports, each support including a top, a first side, a second side, a bottom, a length, a first end, a second end, an aperture, and a substantially hollow channel shape;

a plurality of cross rails positioned substantially perpendicular to the supports, each cross rail engaging the top of the supports and connecting adjacent supports;

a first locating plate positioned proximate to the first end of each support and substantially perpendicular to the supports;

a second locating plate positioned proximate to the second end of each support and substantially perpendicular to the supports;

wherein the first and second locating plates substantially position the fill media on the base; and each support further including a plurality of openings positioned substantially perpendicular to the length, wherein moisture within the moisture collection area flows through the aperture in a first direction and through the openings in a second direction substantially perpendicular to the first direction.

3. A base for a cross flow cooling tower having a fill media comprising:

a plurality of elongated supports, each support including a top, a first side, a second side, a bottom, a length, a first end, a second end, and a substantially hollow channel shape;

a plurality of cross rails positioned substantially perpendicular to the supports, each cross rail engaging the top of the supports and connecting adjacent supports;

a first locating plate positioned proximate to the first end of each support and substantially perpendicular to the supports;

a second locating plate positioned proximate to the second end of each support and substantially perpendicular to the supports;

wherein the first and second locating plates substantially position the fill media on the base; and wherein each end of each support includes a groove shaped to accept one of the locating plates.

4. A base for a cross flow cooling tower having a fill media comprising:

a plurality of elongated supports, each support including a top, a first side, a second side, a bottom, a length, a first end, a second end, and a substantially hollow channel shape;

a plurality of cross rails positioned substantially perpendicular to the supports, each cross rail engaging the top of the supports and connecting adjacent supports;

a first locating plate positioned proximate to the first end of each support and substantially perpendicular to the supports;

a second locating plate positioned proximate to the second end of each support and substantially perpendicular to the supports;

a plurality of openings substantially aligned between the sides of each support; and wherein the first and second locating plates substantially position the fill media on the base.

5. The support of claim 3, wherein:

each support includes a plurality of notches spaced along the length and traversing the support substantially perpendicular to the length; and the plurality of cross rails are positioned in the notches.

6. The support of claim 3, wherein the cross rails are positioned on the top of each support.

7. The support of claim 3, wherein each end of each support includes an outward slope from the top to the bottom.

8. A cooling tower for an air processing system comprising a plurality of heat exchanging plates positioned to form a fill media;

a moisture collection area positioned under the plurality of heat exchanging plates;

a base supporting the plurality of heat exchanging plates and positioned substantially within the moisture collection area; and the base including a plurality of elongated supports, each support including a length, an aperture traversing the support substantially parallel to the length, and a plurality of openings traversing the support substantially perpendicular to the length, wherein the aperture and the openings allow the flow of moisture in at least two substantially perpendicular directions within the moisture collection area.

9. The cooling tower of claim 8, wherein each elongated support further includes a top, sides, a bottom, a first end and a second end.

10. The cooling tower of claim 9, further including a plurality of indentations positioned in the top perpendicular to the length.

11. The cooling tower of claim 10, further including a first cross rail positioned in one of the indentations and connecting adjacent supports to support the fill media.

12. The cooling tower of claim 9, wherein the openings are positioned on the sides of each support and are substantially aligned between the sides of each support.

13. The cooling tower of claim 9, further including:

a first locating plate positioned proximate to the first end of each support and substantially perpendicular to each support;

a second locating plate positioned proximate to the second end of each support and substantially perpendicular to each support; and wherein the first and second locating plates substantially position the fill media on the base.

14. The cooling tower of claim 8, wherein each support is composed of composite.

15. An evaporative heat exchanging device comprising:

a heat exchanging system;

a moisture collection area positioned under the heat exchanging system; and a composite base supporting the heat exchanging system and positioned substantially within the moisture collection area, the base including a plurality of composite supports, each support including:

a top;

first and second sides;

a bottom;

first and second ends;

a length;

a plurality of openings positioned in each side;

an aperture substantially spanning the length; and wherein moisture within the moisture collection area flows through the aperture in a first direction and through the openings in a second direction substantially perpendicular to the first direction.

16. The evaporative heat exchanging device of claim 15, each support further including a plurality of indentations positioned in the top perpendicular to the length.

17. The evaporative heat exchanging device of claim 16, the base further including a plurality of cross rails, each cross rail positioned in one of the indentations, connecting adjacent supports, and supporting the heat exchanging system.

18. The evaporative heat exchanging device of claim 15, the base further including:

a first locating plate positioned proximate to the first end of each support and substantially perpendicular to each support;

a second locating plate positioned proximate to the second end of each support and substantially perpendicular to each support; and wherein the first and second locating plates substantially position the heat exchanging system on the base.

19. The evaporative heat exchanging device of claim 15, the base further including a plurality of cross rails, each cross rail positioned on the top of each support and engaging the heat exchanging system.

* * * * *